US008431319B2

(12) United States Patent
Lai et al.

(10) Patent No.: US 8,431,319 B2
(45) Date of Patent: Apr. 30, 2013

(54) TONER WASH COMPRISING IONIC LIQUID

(75) Inventors: Zhen Lai, Webster, NY (US); Chieh-Min Cheng, Webster, NY (US); Zhaoyang Ou, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 13/069,180

(22) Filed: Mar. 22, 2011

(65) Prior Publication Data

US 2012/0244466 A1 Sep. 27, 2012

(51) Int. Cl.
*G03G 9/00* (2006.01)

(52) U.S. Cl.
USPC ..... 430/137.14; 430/137.1

(58) Field of Classification Search ..... 430/108.1, 430/109.1, 137.1, 137.14
See application file for complete search history.

(56) References Cited

U.S. PATENT DOCUMENTS

| | | | | |
|---|---|---|---|---|
| 6,203,963 | B1 * | 3/2001 | Duff et al. | 430/137.11 |
| 7,439,004 | B2 * | 10/2008 | Malachowski et al. | 430/137.1 |
| 2012/0148950 | A1 * | 6/2012 | Lai et al. | 430/137.14 |

* cited by examiner

*Primary Examiner* — Stewart Fraser
(74) *Attorney, Agent, or Firm* — MDIP LLC

(57) ABSTRACT

A washing process using one or more ionic liquids (ILs) as a washing aid agent for toners, including toners produced using such ILs, such as, low melt toners, is provided. ILs are environmentally sound, green solvents that act to swell toner particle surfaces so that surface absorbed and adsorbed pollutants, such as, surfactants and other manufacturing reactants, can be effectively removed. The resulting toners have good charging, charge maintenance and RH sensitivity.

18 Claims, No Drawings

TONER WASH COMPRISING IONIC LIQUID

FIELD

A washing process using ionic liquids (ILs) as washing aid agents for producing toner, such as, emulsion aggregation (EA) toners, such as, ultra low melt toners, is disclosed, including methods for making said toners using ILs, as well as toner products resulting from such use.

BACKGROUND

Toner manufacturing processes often employ various surfactants, ions and other additives, for example, to facilitate reaction steps, impart a desired property on an intermediate, to enhance reaction yield and so on. For example, ions can be introduced into an EA process to control particle size and shape, including providing stability of the toner particles during aggregation and coalescence.

Toner triboelectric charge, toner flowability and other properties contribute to use of same and to producing images of quality. Such properties depend, in part, on the surface characteristics of a toner, which can, for example, contribute or shape toner surface charge and charge capacity.

Thus, it can be beneficial to have nonessential entities at the toner particle surface, such as, surfactants and ions, removed from the final toner. For example, surfactant may cause toner to lose charge. Also, surfactant can impact environmental resistance. Hence, surface surfactants and ions may have a negative influence on the toner at high temperature and/or humidity, for example, preventing. stable development and adequate transfer of toner. In addition, pollution on the surface of the toner may lead to decrease in toner flowability and/or preservation properties, resulting in decreases in toner properties and product consistency.

Ionic Liquids (ILs) are organic salts which can have melting points below, for example, 100° C. While ordinary liquids, such as, water and gasoline, are predominantly made of electrically neutral molecules, ILs are largely made of ions and short-lived ion pairs. ILs also are known as liquid electrolytes, ionic melts, ionic fluids, fused salts, liquid salts or ionic glasses. In general, ILs combine a unique set of properties, including, but not limited to, non-volatility, non-flammability, electrical conductivity and highly selective solubility. Some IL's have a low negative impact on the environment, being, for example, relatively non-toxic and/or readily degraded. Such distinctive properties make ILs attractive alternatives in fields such as, organic chemistry, electrochemistry, catalysis, physical chemistry and engineering.

Washing protocols using water have been used to remove pollutants from toner surfaces (see, e.g., U.S. Pat. No. 7,439,004). Such protocols require high amounts of water, multiple washing steps and long cycle times. However, that can only remove surfactants/ions from the water phase and superficial particle surfaces, leaving behind bound pollutants or those beneath or within the superficial layers, which pollutants can have a critical impact on toner performance.

It is desirable, therefore, to integrate an aid into a toner manufacturing process to control the surfactants, ions and so on, which can have a negative on the environment, on toner particle surfaces and at the same time to have a lower negative impact on the environment, such as, lower water usage when producing EA toners. The unique properties of ILs, which can be readily degraded, provide a versatile, effective, economical and safe toner washing protocol.

SUMMARY

The instant disclosure provides a washing method using ionic liquids (ILs) as washing aid agents for producing toner, for example, low melt toner. ILs as described herein can swell toner particle surfaces so that surface adsorbed and absorbed surfactants and other manufacturing reactants on or in the surface layers, including ions, can be removed more efficaciously. The described process results in toner with, in part, good charging, charge maintenance and RH sensitivity.

In an embodiment, a method for processing a plurality of toner particles is disclosed including contacting a slurry containing a plurality of toner particles with a first ionic liquid (IL), removing the liquid in the slurry to form a first wet toner cake, optionally dispersing the first wet toner cake with a dispersing solution containing water or an aqueous solution, where the dispersing solution contains a second IL, if a second IL is used, removing the dispersing solution to form a second wet toner cake, contacting the first or second wet toner cake with water or an aqueous solution, and removing the water or aqueous solution to form a dry mass, where the dry mass includes a plurality of IL-contacted toner particles, and where the processing steps remove surfactants and ions from superficial layers of the toner particles. In embodiments, the IL swells the surfaces of the toner particles.

In embodiments, a single wash comprising an IL is used. In embodiments, the first IL and second IL are the same. In embodiments, the first and second ILs are different. In embodiments, the IL comprises an imidazolium, pyrazolium, pyridinium, pyrimidinium, pyrazinium, tetra-alkylammonium or tetra-alkylphosphonium cation. In embodiments, the IL is 1-(4-sulfobutyl)-3-methylimidazolium hydrogen sulfate.

In embodiments, toner particles are obtained by a known method, where the concentration of surfactants, additives and/or ions in or on the superficial or surface layers of IL-washed toner particles are decreased compared to toner particles processed in the absence of IL or washed only with water or an aqueous solution. In embodiments, the triboelectric charge of the IL-washed toner particles is increased compared to toner particles processed in the absence of IL. In embodiments, the A(t) value of IL-washed toner particles is increased compared toner particles processed in the absence of IL. In embodiments, the $T_g$, rheology and/or MFI of an IL-washed toner remains unchanged or is improved or enhanced compared to that of water-only washed toner particles.

For a better understanding of the disclosure as well as other aspects and further features thereof, reference is made to the following description.

DETAILED DESCRIPTION

The present disclosure provides a washing method using ionic liquids (ILs) for making toner, such as, toner comprising an acrylate or a polyester, such as, a toner made by an emulsion aggregation method, such as, a low melt toner.

In an embodiment, a method for processing a plurality of toner particles is disclosed including (a) contacting a slurry containing the plurality of toner particles with a first ionic liquid (IL), (b) removing the liquid in the slurry to form a first wetcake, (c) optionally dispersing the first wetcake with a dispersing solution containing water or an aqueous solution, where the dispersing solution contains a second IL, (d) if step (c) is practice, removing the dispersing solution to form a second wetcake, (e) contacting the first or second wetcake with water or an aqueous solution, and (f) removing the water or aqueous solution to form a dry mass, where the dry mass includes a plurality of IL-contacted toner particles, and where the processing steps remove surfactants and ions from superficial or surface layers of the plurality of toner particles. In embodiments, the IL swells the surfaces of the toner particles.

In an embodiment, if the IL is used in step (a), then a second IL may not be necessary. Alternatively, if the IL is used in step (c), then the first IL may not be necessary. The first and second IL may be the same or different.

In embodiments, a method of making toner particles is disclosed including aggregating dispersions comprising one or more resins, and, optionally, with other reagents, such as, pigments, surfactants, coagulants, aggregants, waxes, base and so on, mixing the resulting aggregation with water, contacting the slurry with a first IL, removing the liquid to form a first wetcake, optionally dispersing the first wetcake with a dispersing solution containing water or an aqueous solution, where the dispersing solution includes a second IL, if a second IL is used, removing the dispersing solution to form a second wetcake, contacting the first or second wetcake with water or an aqueous solution; and removing the water or aqueous solution to form a dry mass, where the resulting dry mass contains one or more toner particles.

In embodiments, a toner particle obtained by washing with an IL is disclosed, where the resulting IL-washed toner contains lower surface concentrations of surfactants, surface additives and/or ions compared to water-only washed toner particles, and where the $T_g$, rheology and melt flow index (MFI) of the IL-washed toner particle remains unchanged or is improved or enhanced compared to water-only washed toner particles.

As used herein, the term, "latex," means a natural or synthetic polymerized monomer that may be emulsified with a surfactant.

In the application, use of the singular includes the plural unless specifically stated otherwise. In the application, use of, "or," means, "and/or," unless stated otherwise. Furthermore, use of the term, "including," as well as other forms, such as, "includes," and, "included," is not limiting.

For the purposes of the instant disclosure, "toner," "developer," "toner composition," and "toner particles," can be used interchangeably, and any particular or specific use and meaning will be evident from the context of the sentence, paragraph and the like in which the word or phrase appears.

For the purposes of the instant application, "about," is meant to indicate a deviation of 20% or less of a stated value or a mean value.

In embodiments, toner compositions of the present disclosure possess enhanced electrical properties, and in embodiments, for extended time periods compared to toner compositions not treated with an IL. The IL-treated toner compositions of interest, for example, comprise an increase in triboelectric charging values, and an increase in A(t) (i.e., charging ability).

Ionic Liquids

ILs are solvents composed of ionized species in contrast to traditional organic or aqueous solvents which often are molecular nonionics. ILs are implemented as green reagents or solvents to replace common volatile or more toxic organic compounds. Ionic liquids can comprise an organic cation, for example, created by alkylation of a compound, including, but not limited to, imidazoles, pyrazoles, thiazoles, isothiazoles, azathiozoles, oxothiazoles, oxazines, oxazolines, oxazaboroles, dithiozoles, triazoles, selenozoles, oxaphospholes, pyrroles, boroles, furans, thiophens, phospholes, pentazoles, indoles, indolines, oxazoles, isoxazoles, isotriazoles, tetrazoles, benzofurans, dibenzofurans, benzothiophens, dibenzothiophens, thiadiazoles, pyridines, pyrimidines, pyrazines, pyridazines, piperazines, piperidines, morpholones, pyrans, annolines, phthalazines, quinazolines and quinoxalines, and combinations thereof.

The anionic portion of an IL can be composed of an inorganic or organic moiety and can comprise halogens, $BX_4^-$, $PF_6^-$, $AsF_6^-$, $SbF_6^-$, $NO_2^-$, $NO_3^-$, $SO_4^{2-}$, $BR_4^-$, substituted or unsubstituted carboranes, substituted or unsubstituted metallocarboranes, phosphates, phosphites, polyoxometallates, substituted or unsubstituted carboxylates, triflates and noncoordinating anions; and where X is halide and R includes, but is not limited to, hydrogen, alkyl, substituted alkyl, cycloalkyl, substituted cycloalkyl, heteroalkyl, heterocycloalkyl, substituted heterocycloalkyl, aryl, substituted aryl, heteroaryl, substituted heteroaryl, alkoxy, aryloxy, acyl, silyl, boryl, phosphino, amino, thio, seleno and combinations thereof. Altering the combination of cations and anions enables control of the IL to optimize the washing/pollutant removal process of interest.

ILs have a more complex solvent behavior compared with traditional aqueous and organic solvents because ILs are salts and not molecular, nonionic solvents. Types of interactions between ILs and solutes include, dispersion, $\pi$, $-\pi$, $n-\pi$, hydrogen bonding, dipolar and ionic/charge-charge.

In an embodiment, the cation can be derived from an organic compound. The organic compound can be aliphatic, cyclic or both. Examples of heterocyclic groups include, but are not limited to, imidazoles, pyrazoles, thiazoles, isothiazoles, azathiozoles, oxothiazoles, oxazines, oxazolines, oxazaboroles, dithiozoles, triazoles, selenozoles, oxaphospholes, pyrroles, boroles, furans, thiophens, phospholes, pentazoles, indoles, indolines, oxazoles, isoxazoles, isotriazoles, tetrazoles, benzofurans, dibenzofurans, benzothiophens, dibenzothiophens, thiadiazoles, pyridines, pyrimidines, pyrazines, pyridazines, piperazines, piperidines, morpholones, pyrans, annolines, phthalazines, quinazolines, quinoxalines, quinolines, pyrrolidines, isoquinolines and combinations thereof.

The anionic portion of the ionic liquid can comprise, for example, at least one of the following groups: halogens, $BX_4^-$, $PF_6^-$, $AsF_6^-$, $SbF_6^-$, $NO_2^-$, $NO_3^-$, $SO_4^{2-}$, $BR_4^-$, substituted or unsubstituted carboranes, substituted or unsubstituted metallocarboranes, phosphates, phosphites, polyoxometallates, substituted or unsubstituted carboxylates, triflates and noncoordinating anions; and where X is halide and R is at least one member selected from the group consisting of hydrogen, alkyl, substituted alkyl, cycloalkyl, substituted cycloalkyl, heteroalkyl, heterocycloalkyl, substituted heterocycloalkyl, aryl, substituted aryl, heteroaryl, substituted heteroaryl, alkoxy, aryloxy, acyl, silyl, boryl, phosphino, amino, thio, seleno and combinations thereof.

In an embodiment, the IL is the commercially available, 1-(4-sulfobutyl)-3-methylimidazolium hydrogen sulfate (Solvionic Inc.).

Resins

Any resin may be utilized in forming a latex emulsion of the present disclosure. In embodiments, the resin may be a polyester resin, including the resins described in U.S. Pat. Nos. 6,593,049 and 6,756,176, the disclosures of each of which are hereby incorporated by reference in their entirety. In embodiments, the resins may include an amorphous resin, a crystalline resin, and/or a combination thereof, as described in U.S. Pat. No. 6,830,860, the disclosure of which is hereby incorporated by reference in entirety.

In embodiments, the toner particles can comprise acrylates, styrenes, styrene acrylates, styrene methacrylates, butadienes, isoprenes, acrylonitriles, acrylic acids, methacrylic acids, beta-carboxy ethyl acrylates, polyesters, a poly(styrene-butadiene), a poly(methyl styrene-butadiene), a poly(m-ethyl methacrylate-butadiene), a poly(ethyl methacrylate-butadiene), a poly(propyl methacrylate-butadiene), a poly (butyl methacrylate-butadiene), a poly(methyl acrylate-butadiene), a poly(ethyl acrylate-butadiene), a poly(propyl acrylate-butadiene), a poly(butyl acrylate-butadiene), a poly (styrene-isoprene), a poly(methyl styrene-isoprene), a poly (methyl methacrylate-isoprene), a poly(ethyl methacrylate-isoprene), a poly(propyl methacrylate-isoprene), a poly(butyl methacrylate-isoprene), a poly(methyl acrylate-isoprene), a poly(ethyl acrylate-isoprene), a poly(propyl acrylate-isoprene), a poly(butyl acrylate-isoprene), a poly(styrene-propyl acrylate), a poly(styrene-butyl acrylate), a poly(styrene-butadiene-acrylic acid), a poly(styrene-butadiene-methacrylic acid), a poly(styrene-butyl acrylate-acrylic acid), a poly(styrene-butyl acrylate-methacrylic acid), a poly(styrene-butyl acrylate-acrylonitrile), a poly(styrene-butyl acrylate-acrylonitrile-acrylic acid) or combinations thereof.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like, including structural isomers. The diol may be, for example, selected in an amount of from about 40 to about 60 mole %, from about 42 to about 55 mole %, from about 45 to about 53 mole %, and a second diol can be selected in an amount of from about 0.1 to about 10 mole % and from about 1 to about 4 mole % of the resin.

Examples of organic diacids or diesters, including vinyl diacids or vinyl diesters, selected for preparing crystalline resins include oxalic acid, succinic acid, glutaric acid, adipic acid, suberic acid, azelaic acid, sebacic acid, fumaric acid, dimethyl fumarate, dimethyl itaconate, cis 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, or a diester or anhydride thereof. The organic diacid may be selected in an amount of, for example, from about 40 to about 60 mole %, from about 42 to about 52 mole %, from about 45 to about 50 mole %, and a second diacid can be selected in an amount of from about 0.1 to about 10 mole % of the resin.

Examples of crystalline resins include polyesters, polyamides, polyimides, polyolefins, polyethylenes, polybutylenes, polyisobutyrates, ethylene-propylene copolymers, ethylene-vinyl acetate copolymers, polypropylenes, mixtures thereof, and the like. Crystalline resins may be polyester based, such as, poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly (octylene-adipimide), poly(ethylene-succinimide), poly(propylene-succinimide) and poly(butylene-succinimide).

The crystalline resin may be present, for example, in an amount of from about 1 to about 50% by weight of the toner components, from about 5 to about 35% by weight of the toner components. The crystalline resin can possess various melting points of, for example, from about 30° C. to about 120° C. or from about 50° C. to about 90° C. The crystalline resin may have a number average molecular weight ($M_n$), as measured by gel permeation chromatography (GPC) of, for example, from about 1,000 to about 50,000, from about 2,000 to about 25,000, and a weight average molecular weight ($M_w$) of, for example, from about 2,000 to about 100,000, from about 3,000 to about 80,000, as determined by GPC using, for example, polystyrene standards. The molecular weight distribution ($M_w/M_n$) of the crystalline resin may be, for example, from about 2 to about 6 or from about 3 to about 4.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diols selected can vary, and may be present, for example, in an amount from about 40 to about 60 mole % of the resin, from about 42 to about 55 mole % of the resin, and from about 45 to about 53 mole % of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole % based on the starting diacid or diester used to generate the polyester resin.

In embodiments, an unsaturated amorphous polyester resin may be utilized as a resin. Examples of such resins include those disclosed in U.S. Pat. No. 6,063,827, the disclosure of which is hereby incorporated by reference in its entirety. Unsaturated amorphous polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

An example of a linear propoxylated bisphenol A fumarate resin which may be utilized as a resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally, in combination with an amorphous resin as described above, include those disclosed in U.S. Patent Application Publication No. 2006/0222991, the disclosure of which is hereby incorporated by reference in its entirety. In some embodiments, a suitable crystalline resin may include a resin formed of ethylene glycol and a mixture of dodecanedioic acid and fumaric acid co-monomers.

The amorphous resin may be present, for example, in an amount of from about 30 to about 90% by weight of the toner components, or from about 40 to about 80% by weight of the toner components. In embodiments, the amorphous resin or combination of amorphous resins utilized in the latex may have a $T_g$ of from about 30° C. to about 80° C. or from about 35° C. to about 70° C. In embodiments, the combined resins utilized in the latex may have a melt viscosity of from about 10 to about 1,000,000 PaS at about 130° C. or from about 50 to about 100,000 PaS.

One, two, or more resins may be used. In some embodiments, where two or more resins are used, the resins may be in any suitable ratio (e.g., weight ratio) such as for instance of from about 1% (first resin)/99% (second resin) to about 99% (first resin)/1% (second resin) or from about 10% (first resin)/90% (second resin) to about 90% (first resin)/10% (second resin). Where the resin includes an amorphous resin and a crystalline resin, the weight ratio of the two resins may be from about 99% (amorphous resin):1% (crystalline resin), to about 1% (amorphous resin):99% (crystalline resin).

Neutralizing Agent

In embodiments, the resin may be pre-blended with a weak base or neutralizing agent. The base may be a solid, thereby eliminating the need to utilize a solution. In embodiments, the resin and the neutralizing agent may be simultaneously fed through a co-feeding process.

In embodiments, the neutralizing agent may be used to neutralize acid groups in the resins, so a neutralizing agent herein may also be referred to as a, "basic neutralization agent." Any suitable basic neutralization reagent may be used in accordance with the present disclosure. Suitable basic neutralization agents may include both inorganic basic agents and organic basic agents. Suitable basic agents may include ammonium hydroxide, potassium hydroxide, sodium hydroxide, sodium carbonate, sodium bicarbonate, lithium hydroxide, potassium carbonate, combinations thereof and the like. Suitable basic agents may also include monocyclic compounds and polycyclic compounds having at least one nitrogen atom, such as, for example, secondary amines, which include aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines and combinations thereof. The monocyclic and polycyclic compounds may be substituted, and at any carbon position on the ring.

In embodiments, an emulsion formed in accordance with the present disclosure may also include water, (e.g., de-ionized water (DIW or ROW)), in amounts of from about 30% to about 95% or from about 30% to about 60%, at temperatures that melt or soften the resin, from about 40° C. to about 140° C., or from about 60° C. to about 100° C.

The basic agent may be utilized as a solid, such as, for example, sodium hydroxide flakes, so that it is present in an amount of from about 0.001% by weight to about 50% by weight of the resin, from about 0.01% by weight to about 25% by weight of the resin, or from about 0.1% by weight to about 5% by weight of the resin.

As noted above, the basic neutralization agent may be added to a resin possessing acid groups. The addition of the basic neutralization agent may thus raise the pH of an emulsion including a resin possessing acid groups from about 5 to about 12 or from about 6 to about 11. The neutralization of the acid groups may enhance formation of the emulsion.

Surfactants

In embodiments, the process of the present disclosure may include a surfactant. One, two or more surfactants may be used. The surfactants may be selected from ionic surfactants and nonionic surfactants. Anionic surfactants and cationic surfactants are encompassed by the term "ionic surfactants." In embodiments, the total amount of surfactant is present in an amount of from about 0.01% to about 20% by weight of the resin, from about 0.1% to about 16% by weight of the resin, or from about 1% to about 14% by weight of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof and the like. Other suitable anionic surfactants include DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants and any of the foregoing anionic surfactants may be utilized.

Examples of the cationic surfactants, which usually are positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenc as IGEPAL CA-210™, IGEPAL CA-520™, IGEPAL CA-720™, IGEPAL CO-890™, IGEPAL CO720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108. Combinations of these surfactants and any of the foregoing surfactants may be utilized.

Processing

The process includes mixing a composition, optionally, at an elevated temperature, containing a resin and other optional reagents as known in the art and as a design choice to form a latex emulsion.

More than one resin may be utilized in forming the emulsion. A polyester resin may be an amorphous resin, a crystalline resin or a combination thereof. In embodiments, the resin may be an amorphous resin and the elevated temperature may be a temperature above the $T_g$ of the amorphous resin. In embodiments, the resin may be a crystalline resin and the elevated temperature may be a temperature above the melting point of the crystalline resin. In embodiments, the resin may be a mixture of amorphous and crystalline resins and the temperature may be above the $T_g$ of the mixture.

The elevated temperature may be from about 30° C. to about 300° C., from about 50° C. to about 200° C., or from about 70° C. to about 150° C. Mixing may be conducted in an extruder, i.e., a twin screw extruder, a kneader, such as, a Haake mixer, a batch reactor or any other device capable of mixing viscous materials, if needed.

Stirring, although not necessary, may be utilized to enhance formation of the latex. Any suitable stirring device may be utilized. In some embodiments, the stirring may be at from about 10 revolutions per minute (rpm) to about 5,000 rpm, from about 20 rpm to about 2,000 rpm, or from about 50 rpm to about 1,000 rpm. The stirring need not be at a constant speed, and may be varied. For example, as heating of the mixture becomes more uniform, the stirring rate may be increased or decreased.

Emulsion Formation

Once the resin and optional reagents, such as, a neutralizing agent and surfactant, are mixed and melted if necessary, the mixture then may be contacted with a solvent, such as, water, to form a latex emulsion. Water may be added to form a latex with a solids content of from about 5% to about 50% or from about 10% to about 40%. While higher water temperatures may accelerate the dissolution process, latexes can be formed at temperatures as low as room temperature. In embodiments, water temperatures may be from about 40° C. to about 110° C. or from about 50° C. to about 100° C.

Contact between the water and the resin mixture may be achieved in any suitable manner, such as in a vessel or continuous conduit, or in a packed bed. In some embodiments, as the resin mixture travels down the extruder, water may be added at subsequent port(s). This may be advantageous so that the transition from a water in oil to an oil in water emulsion may be gradual, ensuring that the materials continue to mix rather than phase separate, and to optimize emulsion formation in the extruder. In embodiments, the ports may inject preheated de-ionized water into the extruder at rates of from about 40 g/min to about 400 g/min or from about 100 g/min to about 200 g/min.

The product exiting from the extruder may include a stream of latex that is collected in a steam-traced tank with gentle agitation before being discharged for storage and later use in the aggregation/coalescence process described below.

The emulsified resin particles in the aqueous medium may have a size of about 1500 nm or less, such as from about 10 nm to about 1200 nm or from about 30 nm to about 1000 nm. The coarse content of the latex of the present disclosure may be from about 0.01% by weight to about 1% by weight or from about 0.1% by weight to about 0.5% by weight. The solids content of the latex of the present disclosure may be from about 5% by weight to about 50% by weight or from about 30% by weight to about 40% by weight.

Following emulsification, the emulsion may be cooled to room temperature, for example from about 20° C. to about 25° C.

Toner

Once the resin mixture has been contacted with water to form an emulsion as described above, the resulting latex then may be utilized to form a toner by any method within the purview of those skilled in the art. The latex emulsion may be contacted with a colorant, optionally in a dispersion, and other additives to form a toner by a suitable process, for example, by an aggregation and coalescence process.

In embodiments, the optional additional ingredients of a toner composition including colorant, wax, and other additives, may be added before, during or after mixing the resin to form the latex emulsion of the present disclosure. The additional ingredients may be added before, during or after formation of the latex emulsion.

Colorants

Various known suitable colorants, such as dyes, pigments, mixtures of dyes, mixtures of pigments, mixtures of dyes and pigments, and the like, may be included in the toner. In embodiments, the colorant may be included in an amount of, for example, from about 0.1 to about 35% by weight of the toner, or from about 1 to about 15% by weight of the toner, or from about 3 to about 10% by weight of the toner, although the amount of colorant can be outside of those ranges.

As examples of suitable colorants, mention may be made of carbon black like REGAL 330™ (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments can be used as water-based pigment dispersions.

In general, suitable colorants may include Paliogen Violet 5100 and 5890 (BASF), Normandy Magenta RD-2400 (Paul Uhirich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations thereof, and the like.

Other suitable water-based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will be apparent based on the present disclosure.

Wax

Optionally, a wax also may be combined with the resin and a colorant in forming toner particles. The wax may be provided in a wax dispersion, which may include a single type of wax or a mixture of two or more different waxes. A single wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1% by weight to about 25% by weight of the toner particles or from about 5% by weight to about 20% by weight of the toner particles, although the amount of wax can be outside of those ranges.

When a wax dispersion is used, the wax dispersion may include any of the various waxes conventionally used in emulsion aggregation toner compositions. Waxes that may be selected include waxes having, for example, an average molecular weight of from about 500 to about 20,000 or from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax, such as, waxes derived from distillation of crude oil, silicone waxes, mercapto waxes, polyester waxes, urethane waxes; modified polyolefin waxes (such as, a carboxylic acid-terminated polyethylene wax or a carboxylic acid-terminated polypropylene wax); Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, and pentaerythritol tetra behenate; ester waxes obtained from higher fatty acid and multivalent alcohol multimers, such as, diethyleneglycol monostearate, dipropyleneglycol distearate, diglyceryl distearate, and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as, aliphatic polar amide functionalized waxes; aliphatic waxes consisting of esters of hydroxylated unsaturated fatty acids, for example, MICROSPERSION 19™ also available from Micro Powder Inc., imides, esters, quaternary amines, carboxylic acids or acrylic polymer emulsion, for example, JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of an aqueous emulsion or dispersion of solid wax in water, where the solid wax particle size may be in the range of from about 100 to about 300 nm.

Additives

In embodiments, toner particles may also contain other optional additives, as desired or required. For example, a toner may include positive or negative charge control agents, for example, in an amount of from about 0.1 to about 10% by weight of the toner or from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

Flow aid additives may be used, which additives are on the surface of the toner particles. Examples of such additives include metal oxides, such as, titanium oxide, silicon oxide, aluminum oxides, cerium oxides, tin oxide, mixtures thereof, and the like; colloidal and amorphous silicas, such as, AEROSIL™, metal salts and metal salts of fatty acids inclusive of zinc stearate, calcium stearate, or long chain alcohols, such as, UNILIN 700, and mixtures thereof.

A silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of the external additives may be present in an amount of from about 0.1% by weight to about 5% by weight of the toner or from about 0.25% by weight to about 3% by weight of the toner, although the amount of additives can be outside of those ranges. In a related aspect, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000, 3,800,588, and 6,214,507, the disclosures of each of which are hereby incorporated by reference in their entirety.

Toner Preparation

The toner particles may be prepared by any method within the purview of one skilled in the art. Although embodiments relating to toner particle production are described below with respect to an emulsion aggregation process, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which smaller resin particles are aggregated to the appropriate toner particle size and then coalesced to achieve the final toner particle shape, size and morphology.

A mixture may be prepared by adding a colorant and optionally a wax or other materials, which optionally also may be in a dispersion(s) including a surfactant, to the emulsion, which may be a mixture of two or more emulsions containing the resin. The pH of the resulting mixture may be adjusted by an acid such as, for example, acetic acid, nitric acid or the like. In one aspect, the pH of the mixture may be adjusted from about 2 to about 5. Additionally, the mixture may be homogenized. If the mixture is homogenized, homogenization may be accomplished by mixing at about 600 to about 6,000 rpm. Homogenization may be accomplished by any suitable means, including, for example, an IKA ULTRA TURRAX T50 probe homogenizer.

Following preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent such as polyaluminum halides, such as, polyaluminum chloride (PAC), or the corresponding bromide, fluoride, or iodide, polyaluminum silicates, such as, polyaluminum sulfosilicate (PASS), or water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the $T_g$ of the resin.

Suitable examples of organic cationic aggregating agents include, for example, cationic surfactants as described above.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, combinations thereof and the like. Where the aggregating agent is a polyion aggregating agent, the agent may have any desired number of ions present. For example, suitable polyaluminum compounds have from about 2 to about 13 or from about 3 to about 8 aluminum ions.

The aggregating agent may be used in an amount of, for example, from about 0.1% to about 10% by weight, from about 0.2% to about 8% by weight or from about 0.5% to about 5% by weight, of the resin in the mixture.

The particles may be permitted to aggregate until a predetermined desired particle size is obtained. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at such temperature for a time of from about 0.5 hours to about 6 hours or from about hour 1 to about 5 hours, while maintaining stirring, to provide the aggregated particles. Once the predetermined desired particle size is reached, the growth process is halted.

The growth and shaping of the particles following addition of the aggregation agent may be accomplished under any suitable conditions. For example, the growth and shaping may be conducted under conditions where aggregation occurs separate from coalescence. For separate aggregation and coalescence, shearing conditions at an elevated temperature, for example of from about 40° C. to about 90° C. or from about 45° C. to about 80° C., which may be below the $T_g$ of the resin, for example, can be practiced.

Once the desired final size of the toner particles is achieved, the pH of the mixture may be adjusted with a base to a value of from about 3 to about 10 or from about 5 to about 9. The adjustment of the pH may be utilized to freeze, that is, to stop, toner particle growth. The base utilized to stop toner growth may include any suitable base such as, for example, alkali metal hydroxides, such as, for example, sodium hydroxide, potassium hydroxide, ammonium hydroxide, combinations thereof and the like. In a related aspect, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above or as known in the art may be utilized as the shell. In embodiments, an amorphous polyester resin as described above may be included in the shell. In embodiments, the amorphous polyester resin may be combined with a different resin, and then added to the particles as a resin coating to form a shell.

In embodiments, a crystalline polyester resin as described above or as known in the art may be used to form a shell. In embodiments, a crystalline resin may be utilized in combination with a different resin. Multiple resins may be utilized in any suitable amounts, such as, a first amorphous polyester resin may be present in an amount of from about 20% by weight to about 100% by weight of the total shell resin or from about 30% by weight to about 90% by weight of the total shell resin. Thus, a second resin may be present in the shell resin in an amount of from about 0.1% by weight to about 80% by weight of the total shell resin or from about 10% by weight to about 70% by weight of the shell resin.

The shell resin may be applied to the aggregated particles by any method within the purview of those skilled in the art. In embodiments, the resins utilized to form the shell may be in an emulsion including any desired additive(s).

The formation of the shell over the aggregated particles may occur while heating to a temperature of from about 30° C. to about 80° C. or from about 35° C. to about 70° C. The formation of the shell may take place for a period of time of from about 5 minutes to about 10 hours or from about 10 minutes to about 5 hours.

Coalescence

Following aggregation to the desired particle size and application of any optional shell, the particles then may be coalesced to a desired shape, the coalescence being achieved by, for example, heating the mixture to a temperature of from about 45° C. to about 100° C. or from about 55° C. to about 99° C., which may be at or above the $T_g$ of the resins utilized to form the toner particles, and/or changing the stirring, for example to from about 100 rpm to about 1,000 rpm or from about 200 rpm to about 800 rpm. Coalescence may be accomplished over a period of from about 0.01 to about 9 hours or from about 0.1 to about 4 hours.

After aggregation and/or coalescence, the mixture may be cooled to room temperature, such as, from about 20° C. to about 25° C. The cooling may be rapid or slow, as desired. A suitable cooling method may include introducing cold water to a jacket around a reactor. After cooling, the toner particles optionally may be washed, for example, with water, and then dried.

Wash with Ionic Liquid

In various exemplary embodiments of the present disclosure, wash fluid doped with an IL is used to wash toner particles. Washing removes undesired impurities such as, surfactants and residual metal ions retained on the toner particles from the formative processes.

At the end of toner processing, before washing and drying, the overall pollutants, such as, surfactants and ions, are in the continuous aqueous phase; are physically absorbed or adsorbed on the surface of the toner particles; may be contained within the toner particles, although close to the particle surface (superficial or surface layers); or will be within and inside the toner particles. Accordingly, the methods as disclosed herein provide an efficient washing process using ILs as washing aid agents to remove as much of the pollutants as possible. ILs of the present disclosure swell toner particle surfaces so that surface adsorbed and absorbed pollutants and those within superficial layers can be removed effectively, without the need for repeated water washes. Ionic liquids often have slight a resin solubilizing or dissolving activity, while not wanting to be bound by theory, perhaps because of the ionic nature of ILs, the acidic nature of some ILs and so on. In any event, the IL wash has a softening effect on the particles and enables a more thorough removal of pollutants from the particle surface, thereby, for example improving particle charge properties for imaging.

In embodiments, methods according to the disclosure may be performed using any suitable horizontal filter press. In a related aspect, horizontal filtration systems such as those sold under the name LAROX PRESSURE FILTER by Larox Corporation, Jessup, Md. and BETHLEHEM TOWER FILTER by Bethlehem Corporation, Easton, Pa., may be used.

The resulting washed and dried toner particles can be formulated into a developer which can be used in an imaging device as known in the art.

The following Examples illustrate embodiments of the present disclosure. These Examples are intended to be illustrative only and are not intended to limit the scope of the present disclosure. Also, parts and percentages are by weight unless otherwise indicated. As used herein, "room temperature," refers to a temperature of from about 20° C. to about 25° C.

EXAMPLES

Example 1

EA Preparation

In a 20 gallon reactor, 14 parts Latex A (high molecular weight polyester amorphous latex at solids content 35 wt %) was combined with 14 parts Latex B (low molecular weight polyester amorphous latex at solids content 35 wt % made by solvent free process), 4.7 parts Latex C (crystalline polyester latex at solids content 30 wt %), 5.8 parts wax (at solids content 30 wt % with 2.5 pph Tayca surfactant, based on the amount of dry pigment), 6.7 parts cyan 15:3 pigment (at solids content 17 wt % with 7 parts per hundred (pph) Tayca surfactant based on the amount of dry pigment) and 47 parts deionized water (DI). The solution was adjusted to a pH of about 3.2 using 0.3M $HNO_3$. One part of a 10% (by weight) aluminum sulphate solution in water was added under homogenization (stirring) at 2,000 rpm over a period of 5 minutes. The reactor then was stirred at about 50 rpm and was heated to about 48° C. to aggregate the toner particles. When the size of the toner particles reached 5.0 μm, a shell coating was added which consisted of 7.6 parts Latex A, 7.6 parts Latex B, 0.1 part DOWFAX surfactant and 100 parts DI. The reaction was heated to 50° C. When the toner particle size reached 5.8 μm, the pH was adjusted to 5.0 using NaOH. The reactor rpm then was decreased to 45 rpm followed by the addition of 0.7 parts EDTA Versene 100. The pH then was adjusted and maintained at 7.5, and the toner was heated to 85° C. (i.e., the coalescence temperature). When the coalescence temperature was reached, the pH was lowered to about 7.3 to allow for spheroidization (coalescence) of the toner. After about 1.5 to about 3.0 hours, when the desired circularity of about 0.964 was obtained, the toner was "quenched" to less than 45° C. through a heat exchanger. After cooling, the toner was washed (see Example 2), and then dried to a moisture content of below about 1.2 wt %.

Example 2

Dynamic Washing with Doped Ionic Liquid

An acidic IL, 1-(4-sulfobutyl)-3-methylimidazolium hydrogen sulphate, was used in the wash.

Formula (I)

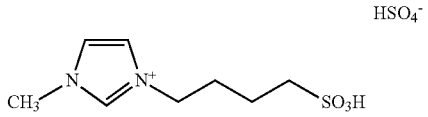

The IL is non-corrosive, easily recyclable and hydrophilic. The IL swells the particle surface so that pollutants in the superficial layers of the toner particle surface can be removed. Meanwhile, the IL also can function as an acid to enhance tribo tuning.

To remove the mother liquor, water or water containing 0.2 wt % of 1-(4-sulfobutyl)-3-methylimidazolium hydrogen sulfate (IL) were added to the slurry after cooling and wet sieving, and mixed for 40 minutes. The slurry then was pumped into a Larox tank according to the manufacturer's recommendations. After pressing under 2 bars, the liquid filtrate was removed and a wet cake was obtained.

The wet cake was discharged and dispersed with 10×DI water based on the final dry toner under mixing for 40 minutes with (0.2%) or without IL. The slurry was pumped into the Larox tank at a controlled rate and feed pumping pressure and de-watered before 11×DI water was pumped into the Larox for dynamic washing. After dynamic washing, the toner cake was subjected to pressure at 8 bars followed by 600 seconds of air dry time.

Example 3

Testing

Table 1 summarizes the results from the dynamic washing method in the presence (cyan toner sample #1) and absence (comparison sample) of IL, 1-(4-sulfobutyl)-3-methylimidazolium hydrogen sulfate.

TABLE 1

Results of Comparisons of Toner Properties and Performance.

| Toner Sample ID | Dowfax (ppm) | Tayca (ppm) | Surface Na by XPS (%) | Toner Bench Tribo Tribo | Toner Bench Tribo A (t) |
|---|---|---|---|---|---|
| Cyan Toner Sample #1 | 3965 | 4500 | 0.44 | 52 | 584 |
| Comparison Sample | 7406 | 5560 | 0.81 | 46 | 523 |

The IL-doped wash reduced residual surfactants and ions on the toner, which resulted in higher toner tribo. Further, other toner properties showed no difference between the toner samples for $T_g$, rheology or melt flow index, indicating that no agent residuals remain to effect potential negatives.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A method for washing toner particles comprising:

a) contacting a slurry containing said toner particles with a first ionic liquid (IL) comprising an imidazolium, pyrazolium, pyridinium, pyrimidinium, pyrazinium, tetra-alkylammonium, or tetra-alkylphosphonium cation;

b) removing the liquid in the slurry to form a first wetcake;

c) contacting the first wetcake with water or an aqueous solution; and d) removing said water or aqueous solution to form a dry mass of toner particles.

2. The method of claim 1, wherein the first IL swells the surface of the toner particles.

3. The method of claim 1, wherein said toner particles comprise an acrylate resin or a polyester resin.

4. The method of claim 1, further comprising:

c1) dispersing the first wetcake with a dispersing solution comprising water or an aqueous solution, wherein the dispersing solution comprises a second IL;

c2) removing the dispersing solution to form a second wetcake; and c3) contacting the second wetcake with water or an aqueous solution.

5. The method of claim 4, wherein the second IL comprises an imidazolium, pyrazolium, pyridinium, pyrimidinium, pyrazinium, tetra-alkylammonium, or tetra-alkylphosphonium cation.

6. The method of claim 5, wherein the first IL is 1-(4-sulfobutyl)-3-methylimidazolium hydrogen sulfate.

7. The method of claim 4, wherein the first IL and the second IL are the same.

8. The method of claim 4, wherein the first IL and the second IL are different.

9. Toner particles obtained by the method of claim 1, wherein the concentration of surfactants, additives and/or ions contributed by said surfactants, additives and/or ions in the superficial layers or on the surface of said IL-contacted toner particles is decreased compared to toner particles washed in the absence of IL.

10. The toner particles of claim 9, wherein the triboelectric charge of the IL-contacted toner particles is increased compared to toner particles washed in the absence of IL.

11. The toner particles of claim 9, wherein the A(t) value of the IL-contacted toner particles is increased compared toner particles washed in the absence of IL.

12. The toner particles of claim 9, wherein said toner particles are emulsion-aggregation toner particles.

13. A developer comprising the toner particles of claim 9.

14. The toner particles of claim 9, comprising lower surface concentrations of surfactants, additives and/or ions compared to water-only washed toner particles, and wherein Tg, rheology, and melt flow index of said toner particle remains unchanged or is enhanced compared to water-only washed toner particles.

15. The toner particle of claim 14, comprising an acrylate.

16. The toner particle of claim 14, comprising a polyester.

17. The toner particle of claim 14, wherein said particle is an emulsion-aggregation toner particle.

18. A developer comprising the toner particle of claim 14.

* * * * *

UNITED STATES PATENT AND TRADEMARK OFFICE

CERTIFICATE OF CORRECTION

PATENT NO. : 8,431,319 B2
APPLICATION NO. : 13/069180
DATED : April 30, 2013
INVENTOR(S) : Lai et al.

It is certified that error appears in the above-identified patent and that said Letters Patent is hereby corrected as shown below:

Delete Title Page, and replace with new Title Page. (Attached)

In the Claims

Cancel claims 9-18.

Signed and Sealed this
Eighteenth Day of March, 2014

Michelle K. Lee

Michelle K. Lee
*Deputy Director of the United States Patent and Trademark Office*

(12) United States Patent
Lai et al.

(10) Patent No.: US 8,431,319 B2
(45) Date of Patent: Apr. 30, 2013

(54) TONER WASH COMPRISING IONIC LIQUID

(75) Inventors: Zhen Lai, Webster, NY (US); Chieh-Min Cheng, Webster, NY (US); Zhaoyang Ou, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 13/069,180

(22) Filed: Mar. 22, 2011

(65) Prior Publication Data

US 2012/0244466 A1 Sep. 27, 2012

(51) Int. Cl.
*G03G 9/00* (2006.01)

(52) U.S. Cl.
USPC ..... 430/137.14; 430/137.1

(58) Field of Classification Search ..... 430/108.1, 430/109.1, 137.1, 137.14
See application file for complete search history.

(56) References Cited

U.S. PATENT DOCUMENTS

| | | | | |
|---|---|---|---|---|
| 6,203,963 | B1 * | 3/2001 | Duff et al. | 430/137.11 |
| 7,439,004 | B2 * | 10/2008 | Malachowski et al. | 430/137.1 |
| 2012/0148950 | A1 * | 6/2012 | Lai et al. | 430/137.14 |

* cited by examiner

*Primary Examiner* — Stewart Fraser
(74) *Attorney, Agent, or Firm* — MDIP LLC

(57) ABSTRACT

A washing process using one or more ionic liquids (ILs) as a washing aid agent for toners, including toners produced using such ILs, such as, low melt toners, is provided. ILs are environmentally sound, green solvents that act to swell toner particle surfaces so that surface absorbed and adsorbed pollutants, such as, surfactants and other manufacturing reactants, can be effectively removed. The resulting toners have good charging, charge maintenance and RH sensitivity.

8 Claims, No Drawings